United States Patent [19]

Bortolussi

[11] Patent Number: 4,497,289

[45] Date of Patent: Feb. 5, 1985

[54] BEARING CAP FOR AN OVERHEAD CAM-SHAFT OF AN INTERNAL COMBUSTION ENGINE

[75] Inventor: Gérard Bortolussi, Franconville, France

[73] Assignees: Societe Anonyme Automobiles Peugeot; Societe Anonyme Automobile Citroen, both of France

[21] Appl. No.: 501,916

[22] Filed: Jun. 7, 1983

[30] Foreign Application Priority Data

Jun. 14, 1982 [FR] France ..... 82 10330

[51] Int. Cl.[3] ..... F01L 1/46

[52] U.S. Cl. ..... 123/90.27; 123/193 H

[58] Field of Search ..... 123/90.27, 193 H

[56] References Cited

U.S. PATENT DOCUMENTS 4,430,968 2/1984 Futakuchi et al. ..... 123/90.27

FOREIGN PATENT DOCUMENTS 1511082 1/1968 France ..... 123/90.41

*Primary Examiner*—Michael Koczo
*Assistant Examiner*—Peggy A. Neils
*Attorney, Agent, or Firm*—Burns, Doane, Swecker & Mathis

[57] ABSTRACT

Each overhead cam-shaft 4, 5 of the engine is journalled in bearings 6, 7, one half of which is formed in the cylinder head 2, while the other half is formed in common caps 8 bolted to the cylinder head. Provided between each cam-shaft and the central fixing bolt 17 of the caps are apertures 18 providing access to the bolts 3 fixing the cylinder head to the cylinder block 1. There is obtained in this way a more compact engine in which the valves 10, 12 are not inclined to an exaggerated extent.

6 Claims, 2 Drawing Figures

BEARING CAP FOR AN OVERHEAD CAM-SHAFT OF AN INTERNAL COMBUSTION ENGINE

DESCRIPTION

The invention relates to a bearing cap for an internal combustion engine of the type comprising at least one overhead cam-shaft journalled in bearing, one half of which is formed in a cylinder head fixed by bolts to the cylinder block while the other half is formed in caps connected by bolts to the cylinder head.

It is known that the tightening of a cylinder head on a cylinder block must satisfy many requirements which leave little latitude in the choice of the placement of the cylinder head bolts. Further, these bolts must remain accessible notwithstanding the presence of timing means which control the raising of the valves. Thus it may be necessary in engines of the aforementioned type to offset more than necessary an overhead cam-shaft so that the caps of its bearings leave the cylinder head bolts accessible. This opposes the effort to obtain greater compactness of the engine and might result in a more complex shape of the combustion chamber owing to the inclination of the valves.

An object of the invention is to overcome these drawbacks. It therefore provides a bearing cap for an internal combustion engine of the aforementioned type which comprises an aperture located between the cam-shaft and one of the bolts for fixing it to the cylinder head, said aperture being provided for the passage of a cylinder head bolt.

Preferably, the aperture is tapped for the purpose of screwing a fluidtight cover.

According to an advantageous arrangement, when the engine has two overhead cam-shafts, each bearing cap is common to the two shafts, comprises between the latter a single central aperture for the passage of a fixing bolt, and has an aperture for the passage of a cylinder head bolt between each cam-shaft and said central aperture.

Another object of the invention is to provide an internal combustion engine of the aforementioned type, provided with bearing caps such as defined hereinbefore.

One example of the application of the invention to an engine having two overhead cam-shafts is the subject of the following description with reference to the accompanying drawings in which.

Figure 1:
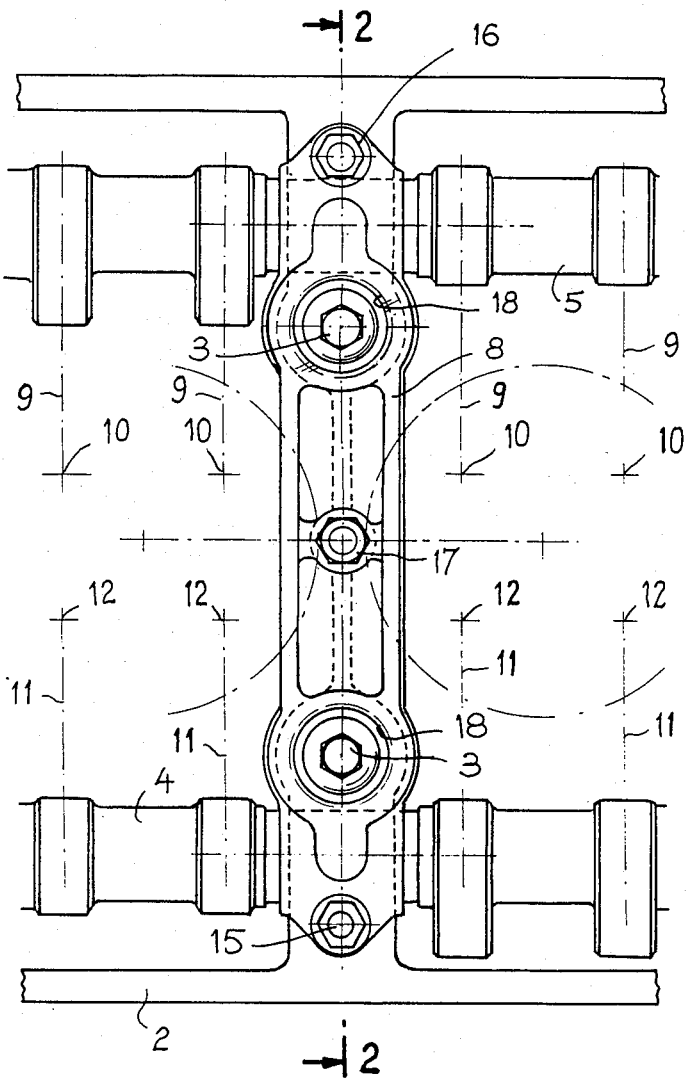
FIG. 1 is a plan view of a bearing cap according to the invention.
Figure 2:
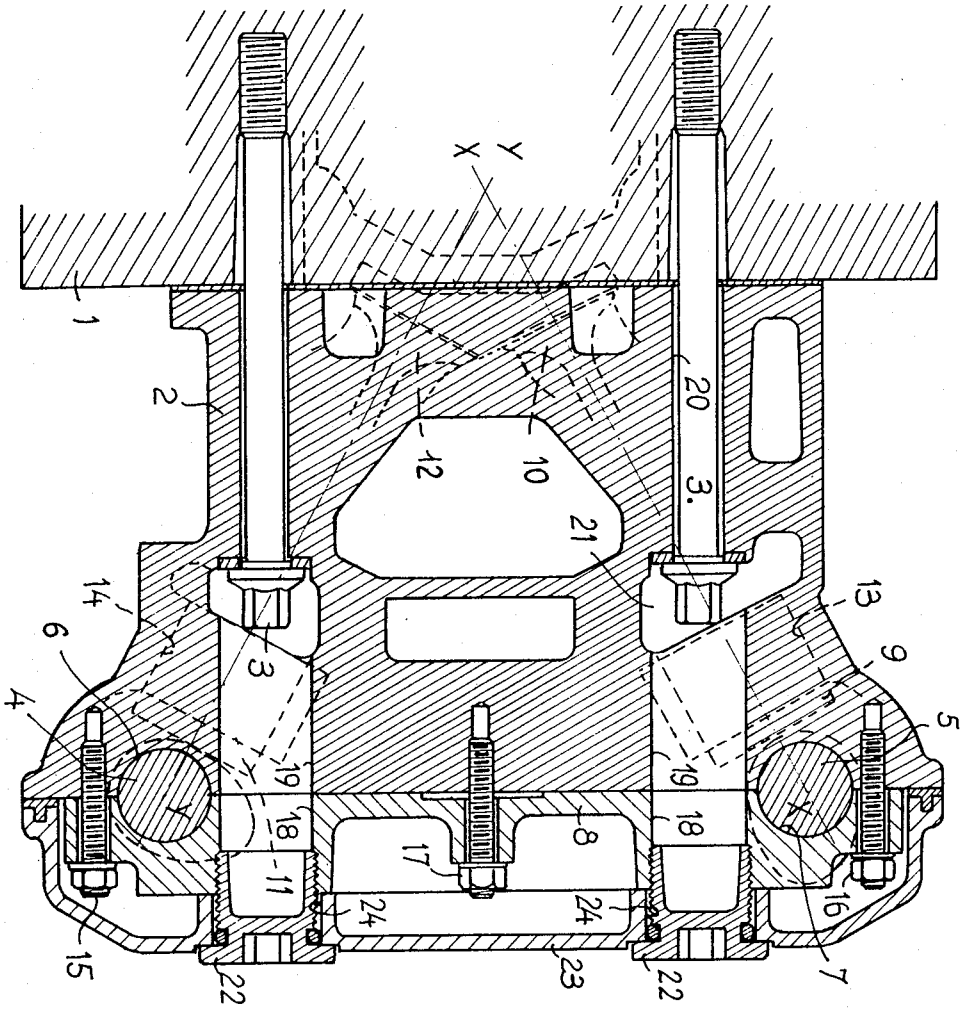
FIG. 2 is a sectional view taken along line 2—2 of FIG. 1.

FIG. 2 shows a part of a cylinder block 1 of an internal combustion engine. A cylinder head 2 is secured to the cylinder block 1 by bolts 3. Two overhead cam-shafts 4, 5 are journalled in bearings 6, 7, one half of which is formed in the cylinder head 2 while the other half is formed in common bearing caps 8 of elongated shape and perpendicular to the two shafts (FIG. 1).

In the illustrated embodiment, the cam-shaft 5 controls, through push-rods 9, the exhaust valves 10 two of which are provided per cylinder, and the cam-shaft 4 controls, through push-rods 11, induction valves 12, two of which are also provided per cylinder. The push-rods 9 and 11 have been represented diagrammatically by their axes in FIG. 1. The push-rods 9 and 11 slide in bores 13, 14 formed in the cylinder head. Their axes X—X and Y—Y converge in the direction of the cylinder block and the two shafts 4 and 5 are located close to each lateral edge of the cylinder head.

The bearing cap 8 common to the two shafts 4 and 5 is secured to the cylinder head 2 by end studs 15, 16, located between the shafts and the lateral edges of the cylinder head, and by a central stud 17. The cap 8 has an aperture 18 between the central stud 17 and each of the cam-shafts. Each aperture 18 has an axis orthogonal to the axis of the cam-shafts, is located in the immediate vicinity of the corresponding shaft 4 or 5 and is in the extension of an aperture 19 formed in the cylinder head 2 in alignment with one of the bolts 3. The aperture 19 allows the head of the bolt 3 to pass therethrough and is extended in the direction of the cylinder block by an aperture 20 which is narrower than this head, with interposition of a cavity 21 which defines a bearing shoulder for this head.

The apertures 18 are tapped, at least in the part thereof remote from the cylinder head, for receiving plugs 22 for fixing a fluidtight cover 23 (not shown in FIG. 1 in the interest of clarity). More precisely, the cover 23 is adapted to be applied, with sealing means, by its periphery against the periphery of the cylinder head and it has in the region of each aperture 18 a smooth aperture 24 in which a plug 22 is received rotatively and with bearing means. When the plugs are screwed in the apertures 18, their head is applied against the outer periphery of the apertures 24 and presses the cover 23 against the cylinder head. Note that in some arrangements it might be sufficient to arrange that only some of the apertures 18 be tapped.

It can be seen that, by means of the arrangement just described, the placement of the timing means is considerably facilitated, even in the complex case of an engine having two overhead cam-shafts and four valves per cylinder.

In particular, the cam-shafts may be placed very close to the axis of the cylinder head bolts while providing full access to the bolts and containing the bearing face of their tightening head outside the regions of the push-rods, as shown, so that there is no risk of distorsion of these regions.

Thus the invention permits a reduction in the angle made by the axes of the induction valves and exhaust valves which reduces the overall size, simplifies the shape of the combustion chamber in the cylinders, and permits the obtainment of high values of the volumetric compression ratio without using complex piston shapes.

Having now described my invention what I claim as new and desire to secure by Letters Patent is:

1. A bearing cap for an internal combustion engine comprising a cylinder block, a cylinder head and at least one overhead cam-shaft journalled in bearings, one half of which bearings is formed in the cylinder head, which cylinder head is secured by bolts to the cylinder block while the other half of said bearings is formed in caps secured by studs to the cylinder head, said cap including an aperture located laterally of the cam-shaft and between the position of the cam-shaft in the cap and the position of one of said studs fixing the cap to the cylinder head, said aperture extending entirely through said cap and being located in alignment with an aperture in the cylinder block which receives one of said bolts securing the cylinder head to the cylinder block.

2. A bearing cap according to claim 1, wherein the aperture is tapped for screwing means for fixing a cover on the cap in a fluidtight manner.

3. A bearing cap for an internal combustion engine including a cylinder block, a cylinder head and two overhead cam-shafts journalled in bearings, one half of which bearings is formed in the cylinder head, which cylinder head is secured by bolts to the cylinder block while the other half of said bearings is formed in caps secured by studs to the cylinder head, wherein said cap is provided for both cam-shafts and is secured by a central stud located between the positions of the two cam-shafts and has between each cam-shaft and said central stud an aperture for the passage of a bolt for securing the cylinder head to the cylinder block.

4. An internal combustion engine comprising a cylinder block, a cylinder head, at least one overhead cam-shaft journalled in bearings, one half of which bearings is formed in the cylinder head which is fixed by bolts to the cylinder block while the other half of said bearings is formed in caps fixed by studs to the cylinder head, each of said caps including an aperture located laterally of the cam-shaft and between the cam-shaft and one of said studs fixing the cap to the cylinder head, said aperture extending entirely through said cap and being provided in alignment with a bolt fixing the cylinder head to the cylinder block to allow passage for the last-mentioned bolt.

5. An engine according to claim 4, wherein a cover is provided for each cap, said aperture in the bearing cap is tapped and receives a fluidtight plug screwthreadedly engaged in the tapped aperture and fixing the cover to the cap.

6. An internal combustion engine comprising a cylinder block, a cylinder head, at least one overhead cam-shaft journalled in bearings, one half of which bearings is formed in the cylinder head which is fixed by bolts to the cylinder block while the other half of said bearings is formed in caps fixed by studs to the cylinder head, wherein there are two overhead cam-shafts and each cap is provided for both cam-shafts and is secured by a central stud located between the two cam-shafts and has between each cam-shaft and said central stud an aperture for the passage of a bolt securing the cylinder head to the cylinder block.

* * * * *